US008905156B2

(12) United States Patent
Varghese et al.

(10) Patent No.: US 8,905,156 B2
(45) Date of Patent: Dec. 9, 2014

(54) DROP AWAY FUNNEL FOR MODULAR DRILLING TEMPLATES

(75) Inventors: Sibu Varghese, Houston, TX (US); Clint Trimble, Houston, TX (US); Christopher Loftin, Houston, TX (US); Jeffrey Allen Raynal, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 226 days.

(21) Appl. No.: 13/443,530

(22) Filed: Apr. 10, 2012

(65) Prior Publication Data

US 2013/0264117 A1 Oct. 10, 2013

(51) Int. Cl.
*E21B 7/124* (2006.01)

(52) U.S. Cl.
USPC ..... 175/7; 175/5; 166/350; 166/351; 166/352; 166/353

(58) Field of Classification Search
CPC ..... E21B 7/124; E21B 7/122; E21B 7/043
USPC ..... 166/341–343, 357, 105; 405/206, 227; 175/10
See application file for complete search history.

(56) References Cited

U.S. PATENT DOCUMENTS

| | | | | |
|---|---|---|---|---|
| 3,533,478 | A * | 10/1970 | Tissier | 173/37 |
| 3,603,408 | A * | 9/1971 | Smulders | 175/6 |
| 4,286,665 | A | 9/1981 | Walker | |
| 4,317,488 | A | 3/1982 | Shotbolt | |
| 4,398,846 | A | 8/1983 | Agdern | |
| 4,437,521 | A | 3/1984 | Richardson et al. | |
| 4,469,181 | A * | 9/1984 | Kellett | 166/341 |
| 4,611,661 | A * | 9/1986 | Hed et al. | 166/339 |
| 4,673,313 | A | 6/1987 | Baugh et al. | |
| 4,674,920 | A * | 6/1987 | Regan et al. | 405/227 |
| 4,693,636 | A | 9/1987 | Fraser, Jr. et al. | |
| 4,867,605 | A | 9/1989 | Myers et al. | |
| 4,927,295 | A | 5/1990 | Knowles | |
| 5,192,167 | A | 3/1993 | da Silva et al. | |
| 5,722,796 | A * | 3/1998 | Halvorsen et al. | 405/195.1 |
| 6,470,973 | B1 * | 10/2002 | Rangnes et al. | 175/7 |
| 7,422,066 | B2 | 9/2008 | Rodrigues et al. | |
| 7,490,670 | B2 * | 2/2009 | Aguilera | 166/341 |
| 2013/0008664 | A1 * | 1/2013 | Graves | 166/358 |

FOREIGN PATENT DOCUMENTS

| | | |
|---|---|---|
| GB | 2285274 A | 7/1995 |
| WO | 9923353 A1 | 5/1999 |

OTHER PUBLICATIONS

PCT Invitation to Pay Additional Fees issued May 30, 2014 in connection with corresponding PCT Patent Application No. PCT/US2013/035966.

* cited by examiner

*Primary Examiner* — James G Sayre
(74) *Attorney, Agent, or Firm* — Bracewell & Giuliani LLP

(57) ABSTRACT

A template for use in positioning subsea wellbores that has a drop away funnel that extends laterally from the template. The drop away funnel is used to locate a piling adjacent the wellbores and is selectively detached from the template after installing the piling. A tang and clevis type assembly mounts the drop away funnel to the template, where the tang and clevis are coupled together with a main stud. The main stud is oriented substantially parallel with an axis of the drop away funnel; so that when the stud is removed, the drop away funnel can decouple from the template and slide axially downward along the piling.

14 Claims, 4 Drawing Sheets

DROP AWAY FUNNEL FOR MODULAR DRILLING TEMPLATES

BACKGROUND

1. Field of Invention

The invention relates generally to method and apparatus for forming a subsea wellbore. More specifically, the invention relates to forming a piling bore and a wellbore at respective designated locations subsea.

2. Description of Prior Art

Subsea drilling templates are sometimes located on the sea floor for drilling a cluster of wellbores in a confined area. Subsea drilling templates typically have a number of receptacles, also referred to as funnels, through which a well will be drilled. Using a floating drilling vessel, the operator may drill each well, cap it, then move to another. At a later date, a platform is generally installed over the template and a tie-back is installed between the wells and platform. Production tubing is then generally connected from the well to production trees installed at the platform.

SUMMARY OF THE INVENTION

Provided herein is an example of a template for use in forming a wellbore in a seafloor. In an example the template is made up of a frame, an annular wellbore alignment funnel coupled with the frame, an annular piling funnel substantially coplanar with the wellbore alignment funnel, and a coupling. The coupling of this embodiment is defined by an overlap between a portion of the frame and the piling funnel. A bore is in the overlap adapted to receive a main stud, so that when the main stud is selectively engaged in the bore, the piling funnel is coupled to the frame, and when the main stud is removed from the bore, the piling funnel is decoupled from the frame. Optionally, the portion of the frame overlapping the piling funnel is an elongated tang member and the portion of the piling funnel overlapped by the frame is a clevis member with a recess adapted to receive the tang member therein. The template may further have sidewalls on the clevis at lateral ends of the recess that extend along elongate sides of the tang member and may include vertical slots in the sidewalls. Alignment members are optionally included that extend laterally from elongate sides of the tang and project through the slots when the tang member is in the recess. The alignment members may be positioned to provide a contact force against the slot as long as the main stud is engaged in the bore. A cup may optionally be included that is on an upper end of the main stud adapted for engagement from a remotely operated vehicle. The piling funnel may in one example be a first piling funnel and the coupling can be a first coupling; in this example the template further includes a second piling funnel substantially coplanar with the wellbore alignment funnel and a second coupling defined by an overlap between a portion of the frame and the second piling funnel, a bore in the overlap, and a main stud, so that when the main stud is selectively engaged in the bore, the second piling funnel is coupled to the frame, and when the main stud is removed from the bore, the second piling funnel is decoupled from the frame. Alternatively, when a piling is inserted through an axial opening in the piling funnel and into the seafloor, and the piling funnel is decoupled from the frame, the piling funnel drops to the seafloor and beneath the frame.

Also described herein is a method of subsea operations. In the example method provided on a seafloor is a drilling template having a wellbore alignment funnel and a piling alignment funnel mounted in a frame. A drill bit is inserted through the wellbore alignment funnel, a wellbore is drilled, and a piling is inserted through the piling alignment funnel. The piling alignment funnel is decoupled from the frame. In the example method, the piling alignment may be lowered to the seafloor. Further, a platform above a surface of the sea can be set over the wellbore, where the piling is used to align the platform at a designated location. The method can further optionally include coupling the piling alignment funnel to the frame by a main stud that is engaged in a bore that intersects the piling alignment funnel and the frame, wherein the piling alignment is substantially parallel with an axis of the piling alignment funnel, and wherein the step of decoupling the piling alignment from the frame comprises disengaging the main stud from within the bore. In one example, the piling alignment funnel is decoupled from the frame while the piling remains inserted in the piling as the piling alignment funnel is dropped to the sea floor. In one example, horizontal alignment of the piling alignment funnel is maintained during the step of decoupling the piling alignment funnel from the frame thereby shielding the main stud from moment forces. Optionally, an alignment element is mounted onto the frame that slides within a vertically formed slot on the piling alignment funnel and maintains the horizontal alignment of the piling alignment funnel.

In another example embodiment, a template for use in forming bores on a seafloor is disclosed herein. In this example the template includes a frame on the seafloor, wellbore alignment funnels mounted to the frame, a piling alignment funnel, a means for selectively coupling the piling alignment funnel to the frame, and a means for retaining the piling alignment funnel in a plane that is substantially parallel with a plane in which the wellbore alignment funnels are disposed when the piling alignment funnel is coupled to the frame and when being decoupled from the frame. In this example, the means for selectively coupling the piling alignment funnel to the frame comprises a main stud that engages a threaded bore that vertically extends through a portion of the frame and a portion of the piling alignment funnel. Optionally, the portion of the frame is a tang member and the portion of the piling alignment funnel is a clevis member. In an alternate embodiment, the means for retaining the piling alignment funnel in a plane can be an alignment member on a lateral side of the frame that slides within a vertical slot provided on the piling alignment funnel.

BRIEF DESCRIPTION OF DRAWINGS

Some of the features and benefits of the present invention having been stated, others will become apparent as the description proceeds when taken in conjunction with the accompanying drawings, in which.

Figure 1:
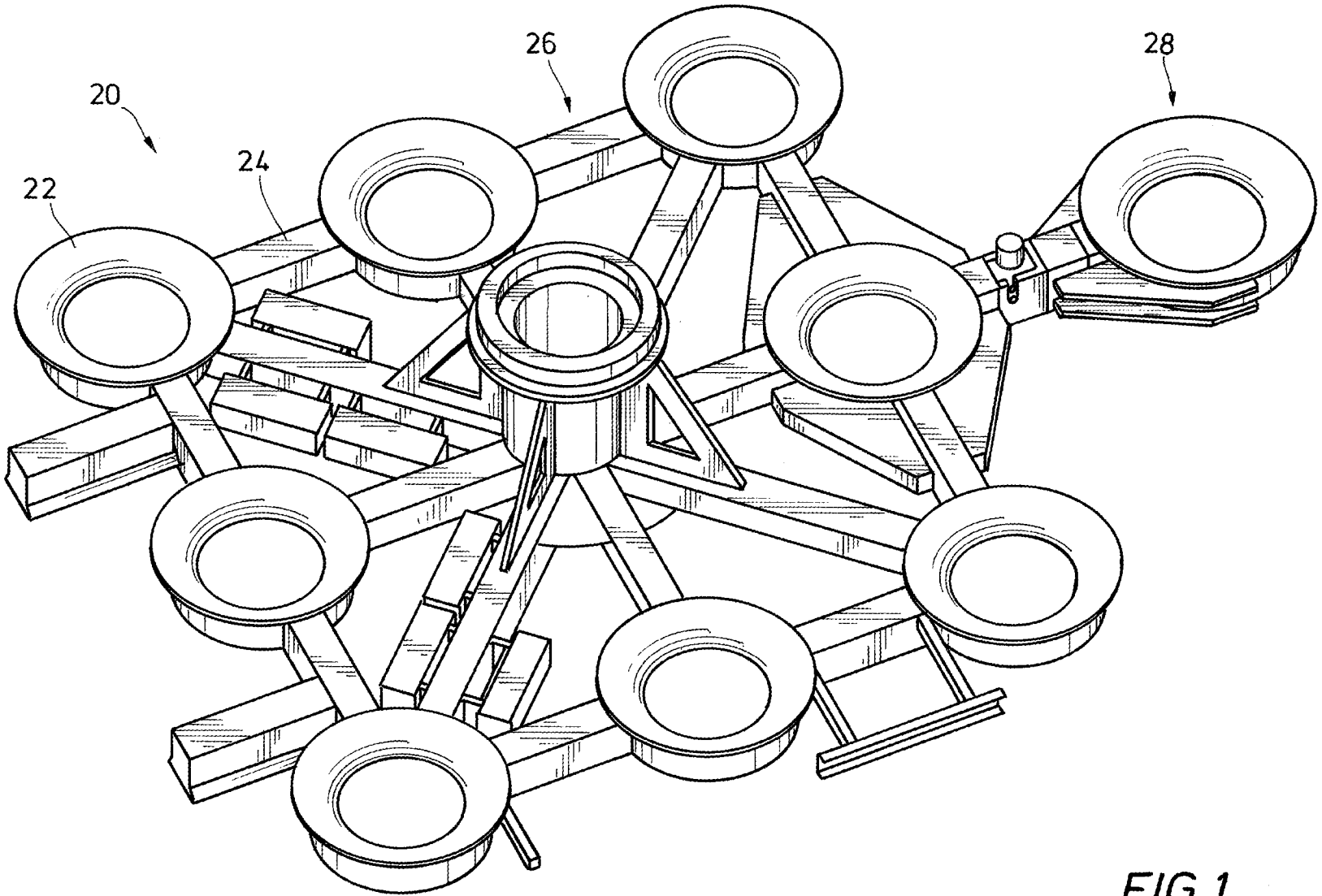
FIG. 1 is a perspective view of an example embodiment of a drilling template in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

An example of a template 20 for aligning bores on a sea floor is shown in a perspective view in FIG. 1. The template 20 of FIG. 1 includes a series of annular wellbore alignment funnels 22 shown in a substantially coplanar arrangement and connected to one another by a series of elongate frame members 24. In the example of FIG. 1, the frame members 24 define a frame 26. In one example, the frame members 24 are structural members, such as I-beams, T-beams, channel members, and the like and can also be hollow and have a circular or rectangular cross section. In an example, the funnels 22 have a conical upward surface to define an upward-facing flange. A piling alignment funnel 28 is also shown in the example of FIG. 1 and mounted on an end of the frame 26.

Figure 2:
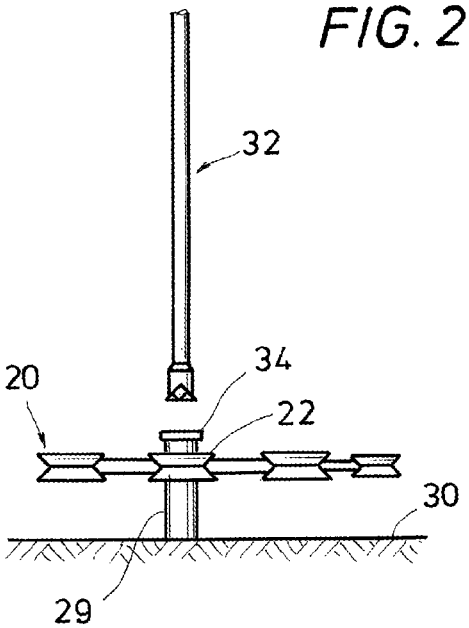
FIG. 2 is a side view of an example of drilling a wellbore through the template of FIG. 1 in accordance with the present invention.
Figure 3:
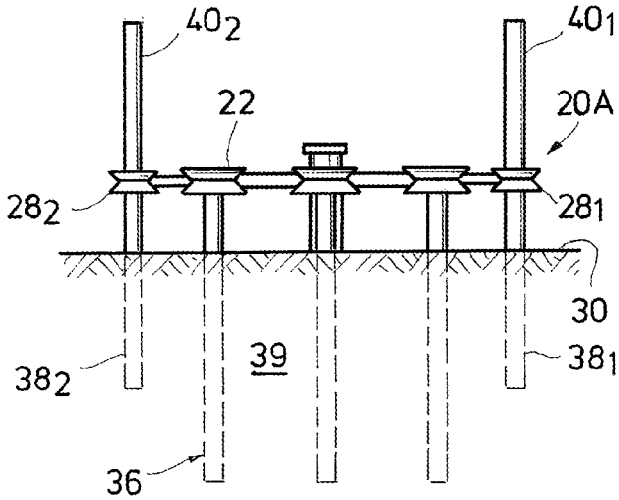
FIG. 3 is a side partial sectional view of wellbores formed using the template of FIG. 1 in accordance with the present invention.

FIG. 2 shows in a side view an example of the template 20 having been landed on a wellhead 29 set in the sea floor 30. Also shown is a drill string 32 being lowered towards the template 20 for forming a wellbore through the sea floor 30. Optionally, a drilling vessel (not shown) may be used for providing the rotating drill string 32. An annular collar 34 is optionally shown disposed within one of the funnels 22 and extending vertically upward from an upper end of the funnel 22 and for receiving a lower end of the drill string 32 therein. Referring now to FIG. 3, illustrated in a side partial sectional view are wellbores 36 (in dashed outline) that extend from the sea floor 30 downward into a formation below the template 20A. In FIG. 3, the example of the template 20A is shown having a second piling arrangement funnel $\mathbf{28}_2$ in addition to a first piling alignment funnel $\mathbf{28}_1$. Similarly, piling bores $\mathbf{38}_1$, $\mathbf{38}_2$ are shown formed in the formation 39 below the sea floor 30 and registering with the respective piling alignment funnels $\mathbf{28}_1$, $\mathbf{28}_2$. In one example of operation, after the piling bores $\mathbf{38}_1$, $\mathbf{38}_2$ are formed, pilings $\mathbf{40}_1$, $\mathbf{40}_2$ are inserted within the bores $\mathbf{38}_1$, $\mathbf{38}_2$.

Figure 4:
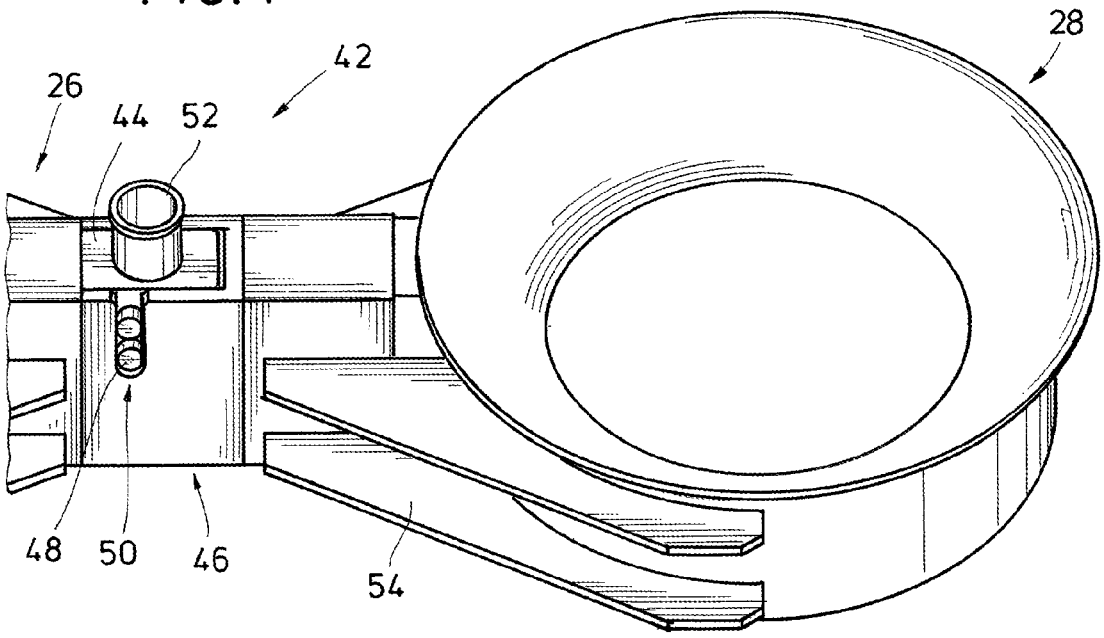
FIG. 4 is a perspective view of a drop away funnel in accordance with the present invention.

FIG. 4 is a perspective view of an example of a coupling 42 that selectively mounts the piling alignment funnel 28 onto the frame 26. In FIG. 4, the example of the coupling 42 includes a tang member 44; which as shown extends from the frame 26. The example tang member 44 is depicted engaging a clevis member 46 illustrated mounted on an end of the piling alignment funnel 28. The example of the tang member 44 of FIG. 4 is generally elongate and includes generally parallel planar members that define opposing lateral sides of the tang member 44. Further shown in the examiner of FIG. 2 are set screw 48 that project outward from an outer surface of each of the lateral sides. Slots 50 are shown vertically oriented along outer lateral sides of the clevis member 46 and in the example of FIG. 4, formed to receive the set screws 48 therein. In an example embodiment, the set screws 48 are within the slots 50 when the piling alignment funnel 28 is engaged with the frame 26. Also shown in FIG. 4 are horizontally disposed support ribs 54 that connect on one end to a lateral side of the clevis member 46 and extend partially around an outer circumference of the piling alignment funnel 28. Also a cup 52 is shown mounted on an upper side of the tang member 44 and as will be described in further detail below is useful for disengaging the piling alignment funnel 28 from the frame 26.

Figure 5:
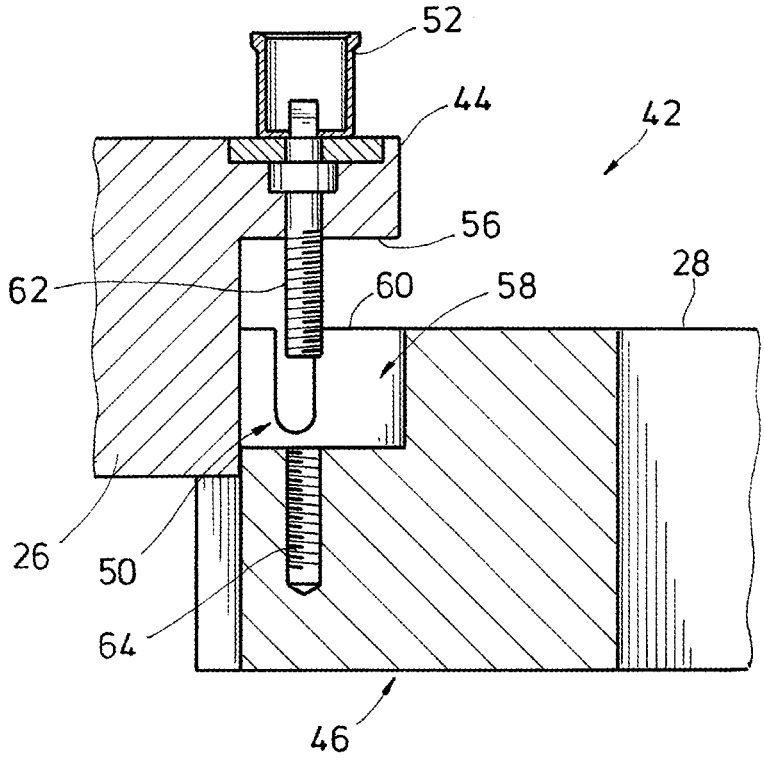
FIG. 5 is a side sectional view of a coupling for an embodiment of the drop away funnel of FIG. 4 in accordance with the present invention.

FIG. 5 is a side sectional view of an example of disengaging the coupling 42 so that the piling alignment funnel 28 may be decoupled from and lowered away from the frame 26. As shown, a forward portion of the tang member 44 is profiled to have a reduced height proximate its terminal end that defines a downwardly-facing shoulder 56. The profiled end of the tang member 44 fits within a recess 58 formed on an outer end of the clevis member 46 so that the shoulder 56 lands on an upward facing surface defined by a bottom of the recess 58. The outer terminal ends of the recess 58 extend outward proximate to an outer lateral surface of the clevis member 46 and define side walls 60 in which the vertical slots 50 are formed. A main stud 62 is shown vertically intersecting the tang member 44 and in the example of FIG. 5 has a threaded portion on its lower end. The threaded portion engages a threaded bore 64 shown extending through a lower surface of the recess 58 in the clevis member 46. Further illustrated in the example embodiment of FIG. 5 is that an upper end of the main stud 62 couples with the cup 52 such that engaging and rotating the cup 52 can selectively engage and disengage the main stud 62 from the bore 64. In the example of FIG. 5, the main stud 62 has been rotated out of engagement with the bore 64 so that the clevis member 46 can be vertically moved downward and away from the tang member 44, thereby allowing disengagement of the piling alignment funnel 28 with the frame 26.

Figure 6:
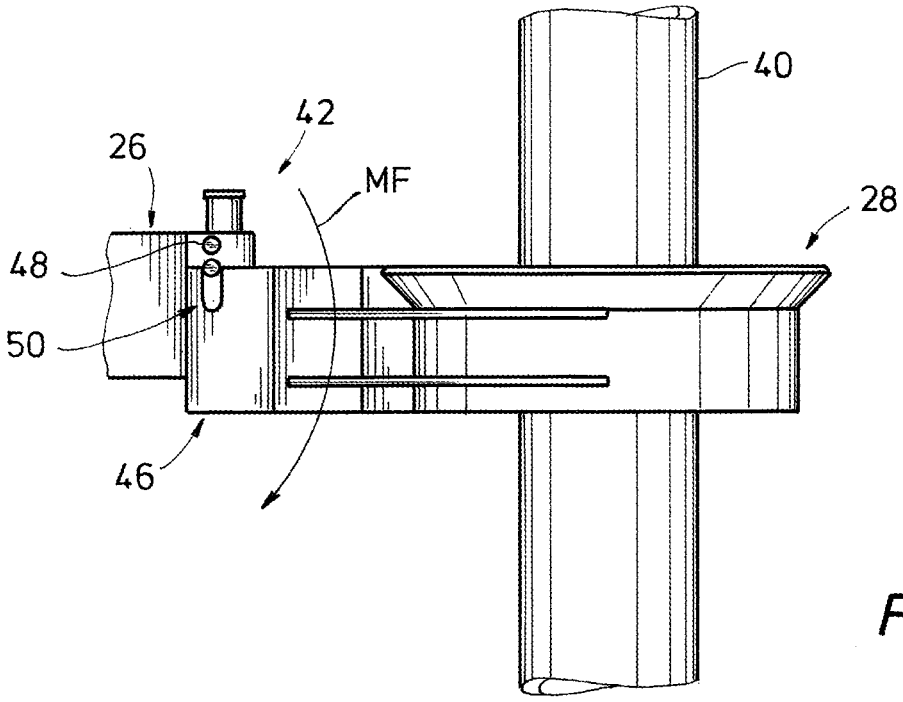
FIG. 6 is a perspective view of an embodiment of the drop away funnel of FIG. 4 with a piling inserted therein in accordance with the present invention.

FIG. 6 illustrates an example embodiment of the piling alignment funnel 28 vertically dropping away from the frame 26 in a side perspective view. In this example moment forces $M_F$ are exerted to the coupling 42 from the weight of the piling alignment funnel 28. The moment forces $M_F$ may fluctuate during operations as contact with the piling 40 may cause the alignment funnel 28 to tilt with respect to the piling 40. The engagement of the slots 50 and set screws 48 largely absorb the moment forces $M_F$ thereby shielding the main stud 62 from what can be damaging bending moments from the weight of the piling alignment funnel 28. Moreover, strategic positioning of the set screws 48 and slots 50 shields the main stud 62 from the bending moments during disengagement of the piling alignment funnel 28 from the frame 26. In an example, the set screws 48 and slot 50 are positioned so that the set screws 48 maintain contact with the slot 50 until a lowermost threaded portion of the main stud 62 has disengaged from an uppermost threaded portion of the threaded bore 64. Still referring to FIG. 6, the piling 40 is shown inserted within the piling alignment funnel 28 such that disengaging the piling alignment funnel 28 from the frame 26 allows the piling alignment funnel 28 to slide axially downward while still circumscribing the piling 40.

Figure 7:
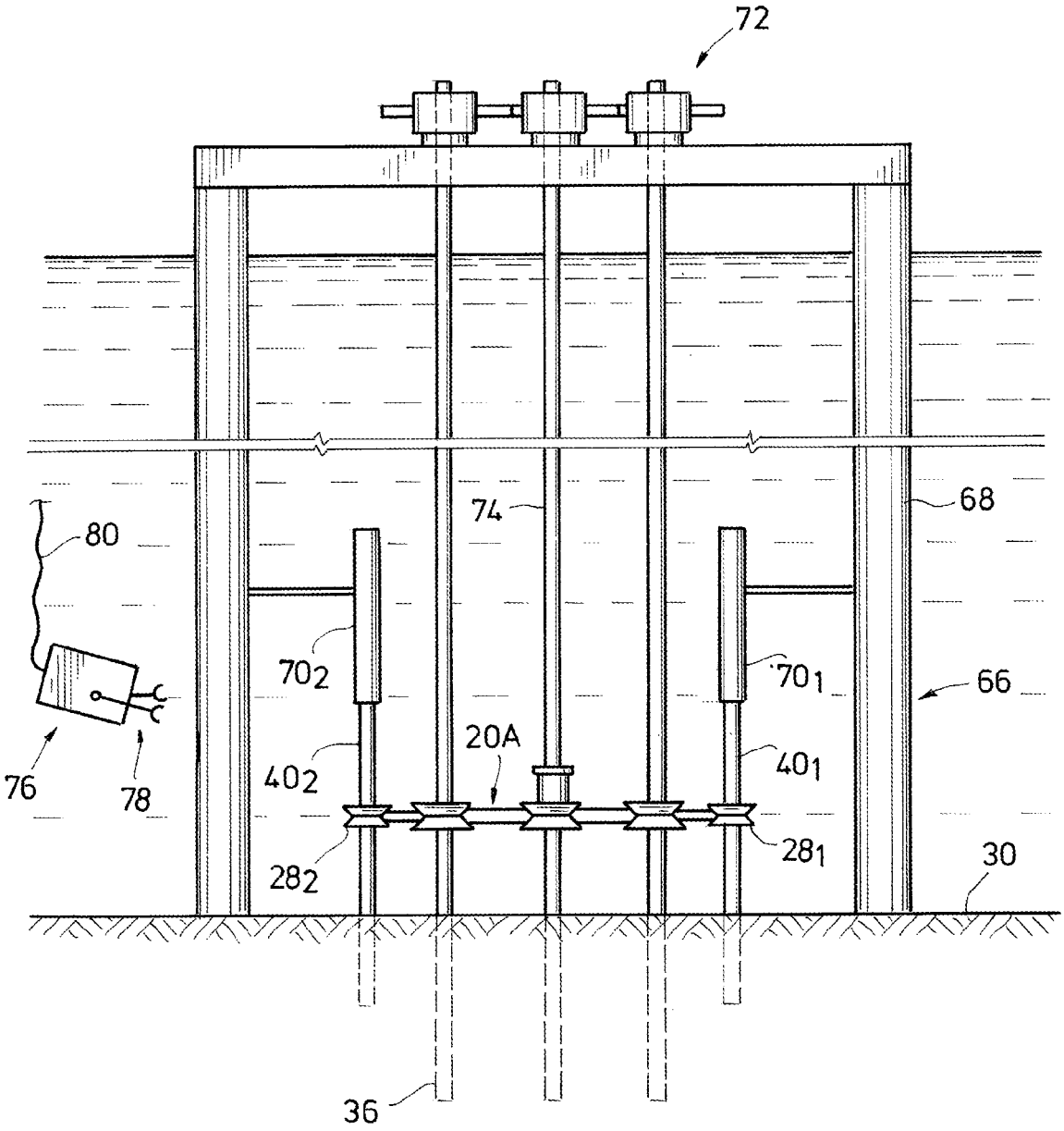
FIG. 7 is a side view of a platform positioned on the seafloor using an embodiment of the piling of FIG. 5 in accordance with the present invention.

FIG. 7 shows a side view of an example of a fixed platform 66 that shown having legs 68 whose lower ends are in contact with the sea floor 30. Alignment tubulars $\mathbf{70}_1$, $\mathbf{70}_2$ are shown coupled with the legs 68 that in the example of FIG. 7 are provided for positioning the platform 66 in a designated location and/or orientation with respect to the wellbores 36. In the example of FIG. 7, the alignment tubulars $\mathbf{70}_1$, $\mathbf{70}_2$ engage the strategically positioned the pilings $\mathbf{40}_1$, $\mathbf{40}_2$ to dispose the platform 66 at the designated location. Although the piling alignment funnels $\mathbf{28}_1$, $\mathbf{28}_2$ are shown on distal ends of the template 20A, the piling alignment funnels $\mathbf{28}_1$, $\mathbf{28}_2$ may be disposed from the same or adjacent the sides of the template 20A. Wellhead assemblies 72 are shown provided on an upper end of the platform 66 and that are in fluid communication with the wellbores 30 via risers 74 that extend from the wellbores 30 and up to the wellhead assemblies 72. An advantage of disengaging the piling alignment funnels $\mathbf{28}_1$, $\mathbf{28}_2$ from the rest of the template 20A is that when the platform 66 is deployed, in the unintended axial forces transferred to the pilings $\mathbf{40}_1$, $\mathbf{40}_2$ will not be transferred to the template 20A and/or the risers 74. As such, potential damage to the template 20, 20A and wellhead assemblies can be prevented by the optional step of decoupling the piling alignment funnels $\mathbf{28}_1$, $\mathbf{28}_2$ from the rest of the template 20, 20A.

Still referring to FIG. 7, an example of a remotely operated vehicle (ROV) 76 is schematically illustrated, wherein the ROV 76 includes mechanical arms 78 for performing functions subsea. A control line 80 may be used for control commands that can in turn direct the ROV 76 subsea so the ROV 76 may manipulate the cup 52 (FIG. 5) and for enabling a remote and subsea decoupling of the piling alignment funnels $\mathbf{28}_1$, $\mathbf{28}_2$ from the template 20A. It necessarily follows that the ROV 76 can be used to decouple funnel 28 from template 20 of FIG. 1. One of the advantages of the engagement of the main stud 62 is that disengaging the main stud from the threaded bore 64 can be accomplished with a lower torque than that might otherwise be required for couplings that exert an axial and a torsional force to retain the piling alignment funnels 28 to the frame 26.

In one example of operation, an embodiment of the template 20 of FIG. 2 or template 20A of FIG. 3 is set at a location on the seafloor 30 and a drill string 32 is used to form wellbores 36 into the seafloor 30 beneath the template 20, 20A as well as bores 38, $\mathbf{38}_1$, $\mathbf{38}_2$, for insertion of pilings 40, $\mathbf{40}_1$, $\mathbf{40}_2$. An ROV 76 can be deployed subsea for manipulating the coupling(s) 42 that releasably fasten the piling alignment funnel(s) 28, $\mathbf{28}_1$, $\mathbf{28}_2$ to the template(s) 20, 20A. As discussed above, unscrewing the main stud 62 allows the piling alignment funnel(s) 28, $\mathbf{28}_1$, $\mathbf{28}_2$ to vertically drop down from the template(s) 20, 20A and decouple the template(s) 20, 20A from the pilings 40, $\mathbf{40}_1$, $\mathbf{40}_2$. As such, subsea deployment of the platform 66 can take place with reduced risk of damage to the template(s) 20, 20A or any other hardware that may be coupled with the template(s) 20, 20A. If the platform impacts the piling while the funnel is attached to the template, the impact can transfer through the funnel and damage the template or misalign the templates and interfere with tieback to the rig once in position. Thus an advantage exists by detaching the funnel from the template.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A template for use in forming a wellbore in a seafloor comprising:

a frame;

an annular wellbore alignment funnel coupled with the frame;

an annular piling funnel substantially coplanar with the wellbore alignment funnel;

a coupling defined by an overlap between an elongated tang member coupled to the frame and a clevis member coupled to the piling funnel, and that has a recess adapted to receive the tang member therein, a bore in the overlap, and a main stud, so that when the main stud is selectively engaged in the bore, the piling funnel is coupled to the frame, and when the main stud is removed from the bore, the piling funnel is decoupled from the frame, and sidewalls on the clevis at lateral ends of the recess that extend along elongate sides of the tang member, vertical slots in the sidewalls, and alignment members that extend laterally from elongate sides of the tang and project through the slots when the tang member is in the recess.

2. The template of claim 1, wherein the alignment members are positioned to provide a contact force against the slot as long as the main stud is engaged in the bore.

3. The template of claim 1, further comprising a cup on an upper end of the main stud adapted for engagement from a remotely operated vehicle.

4. The template of claim 1, wherein the piling funnel comprises a first piling funnel and the coupling comprises a first coupling, the template further comprising a second piling funnel substantially coplanar with the wellbore alignment funnel and a second coupling defined by an overlap between a portion of the frame and the second piling funnel, a bore in the overlap, and a main stud, so that when the main stud is selectively engaged in the bore, the second piling funnel is coupled to the frame, and when the main stud is removed from the bore, the second piling funnel is decoupled from the frame.

5. The template of claim 1, wherein when a piling is inserted through an axial opening in the piling funnel and into the seafloor, and the piling funnel is decoupled from the frame, the piling funnel drops to the seafloor and beneath the frame.

6. A method of subsea operations comprising:

providing a drilling template on a seafloor having a wellbore alignment funnel and a piling alignment funnel mounted in a frame;

inserting a drill bit through the wellbore alignment funnel and drilling a wellbore;

inserting a piling through the piling alignment funnel; and decoupling the piling alignment funnel from the frame so that when the piling alignment funnel is decoupled from the frame, the piling remains inserted in the piling alignment funnel as the piling alignment funnel is dropped to the sea floor.

7. The method of claim 6, further comprising lowering the piling alignment funnel to the seafloor.

8. The method of claim 6, further comprising providing a platform above a surface of the sea and over the wellbore and using the piling to align the platform at a designated location.

9. The method of claim 6, wherein the piling alignment funnel is coupled to the frame by a main stud that is engaged in a bore that intersects the piling alignment funnel and the frame, wherein the piling alignment funnel is substantially parallel with an axis of the piling alignment funnel, and wherein the step of decoupling the piling alignment funnel from the frame comprises disengaging the main stud from within the bore.

10. The method of claim 6, further comprising maintaining a horizontal alignment of the piling alignment funnel during the step of decoupling the piling alignment funnel from the frame thereby shielding the main stud from moment forces.

11. The method of claim 10, wherein an alignment element is mounted onto the frame that slides within a vertically formed slot on the piling alignment funnel maintains the horizontal alignment of the piling alignment funnel.

12. A template for use in forming bores on a seafloor comprising:

a frame on the seafloor;

wellbore alignment funnels mounted to the frame;

a piling alignment funnel;

a means for selectively coupling the piling alignment funnel to the frame; and an alignment member on a lateral side of the frame that slides within a vertical slot providing on the piling alignment funnel, and that is for retaining the piling alignment funnel in a plane that is substantially parallel with a plane in which the wellbore alignment funnels are disposed when the piling alignment funnel is coupled to the frame and when being decoupled from the frame.

13. The template of claim 12, wherein the means for selectively coupling the piling alignment funnel to the frame comprises a main stud that engages a threaded bore that vertically extends through a portion of the frame and a portion of the piling alignment funnel.

14. The template of claim 13, wherein the portion of the frame comprises a tang member and the portion of the piling alignment funnel comprises a clevis member.

* * * * *